US012590378B2

(12) United States Patent
Nunomura et al.

(10) Patent No.: US 12,590,378 B2
(45) Date of Patent: Mar. 31, 2026

(54) METHOD AND APPARATUS FOR PRODUCING ALUMINUM MATERIAL

(71) Applicant: UACJ CORPORATION, Tokyo (JP)

(72) Inventors: Junji Nunomura, Tokyo (JP); Yukio Honkawa, Tokyo (JP); Yoichi Kojima, Tokyo (JP); Tetsuya Tsuda, Osaka (JP)

(73) Assignee: UACJ CORPORATION, Tokyo (JP)

( * ) Notice: Subject to any disclaimer, the term of this patent is extended or adjusted under 35 U.S.C. 154(b) by 590 days.

(21) Appl. No.: 17/481,186

(22) Filed: Sep. 21, 2021

(65) Prior Publication Data

US 2022/0002892 A1 Jan. 6, 2022

Related U.S. Application Data

(63) Continuation of application No. PCT/JP2020/011413, filed on Mar. 16, 2020.

(30) Foreign Application Priority Data

Mar. 22, 2019 (JP) ..... 2019-054223

(51) Int. Cl.
*C25C 3/12* (2006.01)
*C22C 21/02* (2006.01)
*C25C 3/18* (2006.01)

(52) U.S. Cl.
CPC ..... *C25C 3/12* (2013.01); *C22C 21/02* (2013.01); *C25C 3/18* (2013.01)

(58) Field of Classification Search
CPC ..... C25C 3/06–3/24
See application file for complete search history.

(56) References Cited

U.S. PATENT DOCUMENTS

RE30,330 E * 7/1980 Das ..... C25C 3/24 205/377
4,521,281 A * 6/1985 Kadija ..... C25C 3/28 204/263
2002/0070122 A1* 6/2002 Wu ..... C22B 7/002 205/261
2009/0285716 A1 11/2009 Verdier et al.
2015/0122664 A1 5/2015 Sun et al.
2018/0080134 A1 3/2018 Honkawa et al.
2019/0153569 A1* 5/2019 Goto ..... C25D 3/66
(Continued)

FOREIGN PATENT DOCUMENTS

CN 103484891 A 1/2014
CN 107208293 A 9/2017
(Continued)

OTHER PUBLICATIONS

[English Translation] 2nd Office Action dated Jul. 25, 2022 in CN application No. 202080019716.X; pp. all.
(Continued)

*Primary Examiner* — Ciel P Contreras
(74) *Attorney, Agent, or Firm* — Dorsey & Whitney LLP

(57) ABSTRACT

A method for producing an aluminum material, including: providing an electrolytic cell in which an anode electrode containing 0.01 to 30% by mass Si and Al and a cathode electrode are immersed in an electrolytic solution and depositing aluminum on the cathode electrode by energizing the anode electrode and the cathode electrode in the electrolytic solution.

6 Claims, 1 Drawing Sheet

(56) References Cited

U.S. PATENT DOCUMENTS

| | | | |
|---|---|---|---|
| 2019/0292670 | A1 | 9/2019 | Honkawa et al. |
| 2019/0330752 | A1 | 10/2019 | Nunomura et al. |

FOREIGN PATENT DOCUMENTS

| | | | | |
|---|---|---|---|---|
| CN | 109072465 | A | 12/2018 | |
| CN | 110073037 | A | 7/2019 | |
| JP | 85626 | C | 2/1930 | |
| JP | S6417886 | A | 1/1989 | |
| JP | 2003277837 | A | 10/2003 | |
| JP | 2005113271 | A | 4/2005 | |
| JP | 2009541585 | A | 11/2009 | |
| JP | 2014077188 | A | 5/2014 | |
| JP | 2014184466 | A | 10/2014 | |
| WO | WO-2009007440 | A2 * | 1/2009 | ..... C25C 3/06 |

OTHER PUBLICATIONS

[English Translation] Chen Yuhua "New Clean Energy Technology: New Technologies in Chemical and Solar Batteries"; Intellectual Property Press; Jan. 2019; pp. all.

[English Translation] Fang Zhigang et al. "Corrosion and Protection of Submarine Structures", National Defense Industry Press; May 2015; pp. all.

[English Translation] Notice of Rejection dated Jan. 23, 2024 in JP Application No. 2021-509083; pp. all.

English translation of International Preliminary Report on Patentability for Application No. PCT/JP2020/011413, mailed Sep. 28. 2021.

English translation of International Search Report and Written Opinion, mailed on Jun. 2, 2020, for PCT Application No. PCT/JP2020/011413.

[English Translation] Publication Submission Form dated Nov. 1, 2023 in JP Application No. 2021-509083; pp. all.

[English Translation] Notice of Submission of Publications dated Dec. 12, 2023 in JP application No. 2021-509083; pp. all.

[English translation] First Office Action dated Feb. 21, 2022 for Chinese Patent Application No. 202080019716.X; pp. all.

[Partial English translation] "Wrought aluminium and aluminium alloys—Chemical composition limits", National Approval of the People's Republic of China, GB/T, 3190-1996; pp. all.

[English Translation] Decision of Rejection dated Oct. 17, 2022 in CN application No. 202080019716.X; pp. all.

[English Translation] Hengxian Zhao "Melting and Ingot Casting of Cast Aluminum-Silicon Alloys"; Northeastern University Press, Shenyang; Jul. 31, 2006; pp. 9-13.

[English Translation Not Available] Description of Japanese Patent No. 85626.

June Li Xu et al., "Current Efficiency of Recycling Aluminum From Aluminum Scraps by Electrolysis", Transactions of Nonferrous Metals Society of China, vol. 24, Issue 1, Jan. 2014, pp. 250-256.

[English Translation] Notice of Reasons for Refusal dated Oct. 24, 2023 in JP Application No. 2021-509083; pp. all.

[English Translation] Notice of Reasons for Refusal mailed Jul. 4, 2023 for JP Application No. 2021-509083; pp. all.

Li Jian et al. "Metallurgy of Light and Rare Precious Metals", Metallurgical Industry Press, Mar. 2018, with partial English translation relating to p. 198, paragraph 2 of original Chinese language document; pp. all pages provided.

Electrical Engineering Handbook, Editorial Committee of Mechanical Engineering et al., Machinery Industry Press, pp. 3-23, Sep. 1997.

Hydrometallurgy, Yang Xianwan et al., Metallurgical Industry Press, p. 209, 1st edition, Apr. 1998.

Notice of Re-examination dated Jan. 8, 2026 in CN application No. 202080019716.X, with English machine translation; pp. all.

[With English Translation] Decision of Re-examination dated Feb. 27, 2026 in CN application No. 202080019716.X , pp. all.

* cited by examiner

[Figure 1]
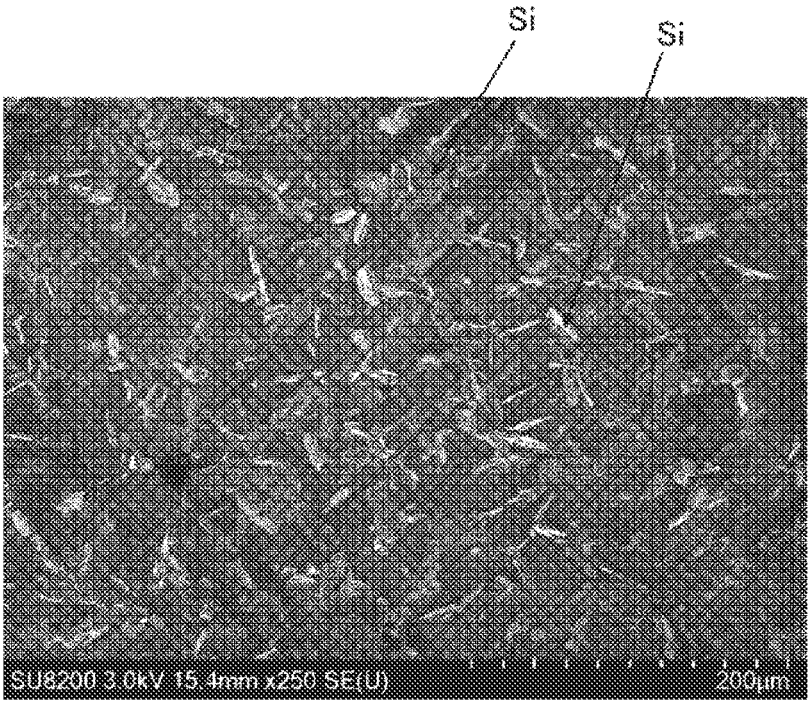
[Figure 2]
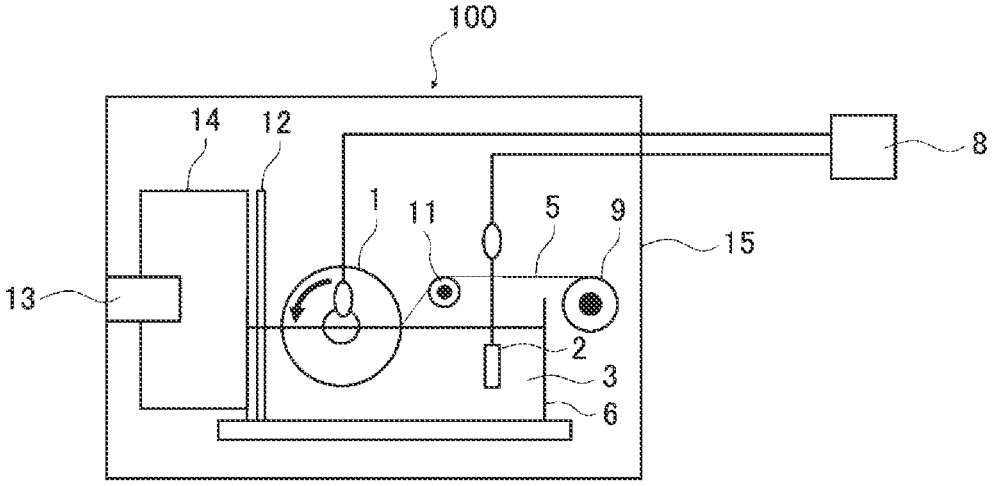

METHOD AND APPARATUS FOR PRODUCING ALUMINUM MATERIAL

CROSS REFERENCE TO RELATED APPLICATIONS

The present application is a continuation application of International Patent Application No. PCT/JP2020/011413 filed on Mar. 16, 2020, which claims the benefit of Japanese Patent Application No. 2019-054223, filed on Mar. 22, 2019. The contents of these applications are incorporated herein by reference in their entirety.

BACKGROUND

Technical Field

The present disclosure relates to a method and an apparatus for producing an aluminum material.

Description of the Related Art

The amount of aluminum alloy scrap generated has been increased simultaneously with a rapid increase in the production of aluminum alloys for automobiles in recent years, and there has been concern regarding treatment methods thereof. Most of aluminum alloy scrap has been conventionally used for secondary alloys for die casting or the like. However, the amount of production of automobiles having an internal combustion engine is expected to decrease, and demand for aluminum alloy scrap as secondary alloys for die casting which are a material for engines made of aluminum alloys also has a high probability of decreasing in the future. Therefore, a need arose for aluminum alloy scrap to be usable also for uses other than secondary alloys for die casting. Accordingly, it has been desired to increase the aluminum purity of aluminum alloy scrap. However, a technique for efficiently removing Si generally contained in aluminum alloy scrap in a large amount to obtain an aluminum material having a high purity has not been proposed until now.

For example, in Japanese Patent Application Laid-Open No. 2003-277837, a method for recycling an aluminum expanded material for automobiles is described. However, although the method of Japanese Patent Application Laid-Open No. 2003-277837 had a step of separating portions containing a large amount of an aluminum expanded material, it was assumed that the aluminum expanded material was recycled and utilized as it was and the method did not have a step of increasing the purity of aluminum.

Japanese Patent Application Laid-Open No. 2009-541585 discloses a method in which the purity of aluminum is increased by melting scrap used in the aviation industry and containing a large amount of an aluminum alloy and then performing segregation to obtain a remelt block. In the method of Japanese Patent Application Laid-Open No. 2009-541585, complicated treatments under high temperature conditions were required for the melting and the segregation of the aluminum alloy. The purity of aluminum in the remelt block obtained by this method was also limited.

As mentioned above, in the conventional methods, a method and an apparatus for producing an aluminum material in which an aluminum material with a high purity is easily produced from a raw material such as aluminum alloy scrap having a high Si content have not been fully examined. That is, the present disclosure is related to providing a method and an apparatus for producing an aluminum material which enables an aluminum material with a high purity to be easily produced from a raw material containing a large amount of Si.

SUMMARY

The present disclosure has the following embodiments.

[1] A method for producing an aluminum material, including:

providing an electrolytic cell in which an anode electrode containing 0.01 to 30% by mass Si and Al and a cathode electrode are immersed in an electrolytic solution and depositing aluminum on the cathode electrode by energizing the anode electrode and the cathode electrode in the electrolytic solution.

[2] The method for producing an aluminum material according to [1], wherein an area ratio of Si to a surface of the anode electrode is 90% or less in depositing aluminum on the cathode electrode.

[3] The method for producing an aluminum material according to [1], wherein the electrolytic solution includes a molten salt containing an alkylimidazolium halide and an aluminum halide.

[4] The method for producing an aluminum material according to [1], wherein the anode electrode includes an aluminum alloy containing Si: 0.01 to 30% by mass, Fe: 1.8% by mass or less, Cu: 5.0% by mass or less, Mg: 10.5% by mass or less, Mn: 1.5% by mass or less, Zn: 3.0% by mass or less, Ni: 0.55% by mass or less, Ti: 0.3% by mass or less, Pb: 0.35% by mass or less, Sn: 0.3% by mass or less, and Cr: 0.15% by mass or less, with the balance being Al and inevitable impurities, and the anode electrode is platy or an aggregate of particles having an average particle size of 1 to 100 mm.

[5] The method for producing an aluminum material according to [1], wherein the anode electrode includes an aluminum alloy containing Si: 0.01 to 30% by mass, Fe: 1.8% by mass or less, Cu: 5.0% by mass or less, Mg: 10.5% by mass or less, and Mn: 1.5% by mass or less, with the balance being Al and inevitable impurities, and the anode electrode is platy or an aggregate of particles having an average particle size of 1 to 100 mm.

[6] An apparatus for producing an aluminum material, including:

an electrolytic cell storing an electrolytic solution;

an anode electrode immersed in the electrolytic cell and containing 0.01 to 30% by mass Si and Al;

a cathode electrode immersed in the electrolytic cell; and a voltage-applying unit configured to enable application of a voltage between the anode electrode and the cathode electrode.

A method and an apparatus for producing an aluminum material which enables an aluminum material with a high purity to be easily produced from a raw material at a high content of Si can be provided.

BRIEF DESCRIPTION OF THE DRAWINGS

FIG. 1 is a scanning electron microscope (SEM) image of the surface of an anode electrode after electrolysis in Example 4.

FIG. 2 is a figure showing an apparatus for producing an aluminum material of one embodiment.

DETAILED DESCRIPTION

1. Method for Producing Aluminum Material

A method for producing an aluminum material according to one embodiment includes (1) providing an electrolytic cell in which an anode electrode containing 0.01 to 30% by mass Si and Al and a cathode electrode are immersed in an electrolytic solution and (2) depositing aluminum on the cathode electrode by energizing the anode electrode and the cathode electrode in the electrolytic solution. In the above-mentioned step (2), aluminum is electrodeposited on the cathode electrode to obtain an aluminum material. Although methods for producing an aluminum material by electrolysis have been conventionally proposed, these methods were related to producing thin aluminum foils with high purities. In the conventional production methods, a raw material containing aluminum with a high purity was therefore used as an anode electrode to obtain aluminum foils with high purities. Meanwhile, in the method for producing an aluminum material of one embodiment, an aluminum material with a high purity is obtained from a raw material of aluminum having a high Si content of 0.01 to 30% by mass and a low purity (anode electrode). At this point, the method for producing an aluminum material of one embodiment is completely different from the conventional methods for producing aluminum foils.

Hereinafter, the steps of a method for producing an aluminum material of one embodiment will be described in detail.

(1) Providing Electrolytic Cell

In the production method of one embodiment, an electrolytic cell in which an anode electrode containing 0.01 to 30% by mass Si and Al and a cathode electrode are immersed in an electrolytic solution is provided. That is, the electrolytic cell which is filled with the electrolytic solution and in which the anode electrode and the cathode electrode are immersed in the electrolytic solution in a predetermined positional relationship is provided.

Hereinafter, members and conditions used in the step (1) will be described in detail.

(Anode Electrode)

As a material forming the anode electrode used in one embodiment, it is preferable to use aluminum alloy scrap such as a casting material. Such a raw material can be procured at low cost. Hereinafter, a preferable aluminum alloy composition (the constituent elements of an aluminum alloy) when a raw material forming the anode electrode is an alloy will be described.

(a) Si

In a casting material, Si is added for increasing the strength of the base material, reducing the coefficient of thermal expansion, and improving the castability. For example, in the case of using aluminum alloy scrap such as a casting material for the anode electrode, or the like, Si is therefore contained in the material forming the anode electrode. When the Si content in the raw material forming the anode electrode is less than 0.01% by mass, the aluminum content in the anode electrode is high originally, it is thus unnecessary to produce an aluminum material with a high purity in the production method of one embodiment. Meanwhile, when the Si content in the raw material forming the anode electrode is more than 30% by mass, Si concentrates on the surface of the anode electrode and the dissolution of Al in an electrolytic solution from the surface of the anode electrode is hindered, or Si is dissolved in the electrolytic solution from the anode electrode to contaminate the electrolytic solution. Therefore, when the anode electrode includes a raw material containing Si at a Si content of 0.01 to 30% by mass and Al, an aluminum material with a high purity can be obtained from the aluminum raw material with a low purity. It is preferable that the Si content in the raw material forming the anode electrode be 0.1 to 25% by mass, it is more preferable that the Si content be 0.5 to 20% by mass, and it is further preferable that the Si content be 1.0 to 18% by mass.

(b) Fe

In a casting material, Fe is added for preventing burning on a mold. For example, when aluminum alloy scrap such as a casting material is used for the anode electrode, Fe is therefore contained in a raw material forming the anode electrode. It is preferable that the Fe content in the raw material forming the anode electrode be 1.9% by mass or less, especially 1.8% by mass or less. When the Fe content is such a Fe content, Fe is hardly incorporated into the Al electrodeposit of the cathode electrode and the purity of Al recovered can be improved. The fragility of the film quality, when the Al electrodeposit contains Fe, can be prevented. It is preferable that the Fe content in the raw material forming the anode electrode be 0.006 to 1.5% by mass, it is more preferable that the Fe content be 0.03 to 1.2% by mass, and it is further preferable that the Fe content be 0.06 to 1.1% by mass.

(c) Cu

In a casting material, Cu is added for increasing the strength of the base material and improving machinability. For example, when aluminum alloy scrap such as a casting material is used for the anode electrode, Cu is therefore contained in the raw material forming the anode electrode. It is preferable that the Cu content in the raw material forming the anode electrode be 5.1% by mass or less, especially 5.0% by mass or less. When the Cu content is such a Cu content, Cu is hardly incorporated into the Al electrodeposit of the cathode electrode and the purity of Al recovered can be improved. The smoothness of the Al electrodeposit can be improved, and the recovery rate of Al can be improved. It is preferable that the Cu content in the raw material forming the anode electrode be 0.017 to 4.0% by mass, it is more preferable that the Cu content be 0.08 to 3.3% by mass, and it is further preferable that the Cu content be 0.17 to 3.0% by mass.

(d) Mg

In a casting material, Mg is added for increasing the strength of the base material and improving the corrosion resistance. For example, when aluminum alloy scrap such as a casting material is used for the anode electrode, Mg is therefore contained in the raw material forming the anode electrode. It is preferable that the Mg content in the material forming the anode electrode be 10.6% by mass or less, especially 10.5% by mass or less. Since Mg is originally a metallic element less noble than Al, Mg tends to be induced by other metal ions and incorporated into the Al electrodeposit of the cathode electrode. However, when the Mg content is a Mg content as mentioned above, the amount of Mg incorporated into the Al electrodeposit of the cathode electrode can be reduced and the purity of Al can be improved. It is preferable that the Mg content in the raw material forming the anode electrode be 0.035 to 9.5% by mass, it is more preferable that the Mg content be 0.18 to 7.0% by mass, and it is further preferable that the Mg content be 0.35 to 6.3% by mass.

(e) Mn

In a casting material, Mn is added for improving the high-temperature strength. For example, when aluminum alloy scrap such as a casting material is used for the anode electrode, Mn is therefore contained in the raw material forming the anode electrode. It is preferable that the Mn content in the material forming the anode electrode be 1.6% by mass or less, especially 1.5% by mass or less. Mn tends to be incorporated into the Al electrodeposit of the cathode electrode. However, when the Mn content is a Mn content as mentioned above, the amount of Mn incorporated into the Al electrodeposit of the cathode electrode can be reduced and the purity of Al can be improved. The Mn content in the Al electrodeposit can be reduced and the recovered material of the electrodeposit can be improved. It is preferable that the Mn content in the raw material forming the anode electrode be 0.005 to 1.2% by mass, it is more preferable that the Mn content be 0.025 to 1.0% by mass, and it is further preferable that the Mn content be 0.05 to 0.9% by mass.

(f) Zn

In a casting material, Zn is added for improving the castability and improving the mechanical properties and the machinability by coexistence with Mg. For example, when aluminum alloy scrap such as a casting material is used for the anode electrode, Zn is therefore contained in the raw material forming the anode electrode. It is preferable that the Zn content in the raw material forming the anode electrode be 3.1% by mass or less, especially 3.0% by mass or less. When the Zn content is such a Zn content, Zn is hardly incorporated into the Al electrodeposit of the cathode electrode and the purity of Al recovered can be improved. The smoothness of the Al electrodeposit can be improved and the recovery rate of Al can be improved. It is preferable that the Zn content in the raw material forming the anode electrode be 0.010 to 2.5% by mass, it is more preferable that the Zn content be 0.05 to 2.0% by mass, and it is further preferable that the Zn content be 0.10 to 1.8% by mass.

(g) Ni

In a casting material, Ni is added for improving the high-temperature strength, the fluidity, and the filling properties. For example, when aluminum alloy scrap such as a casting material is used for the anode electrode, Ni is therefore contained in the raw material forming the anode electrode. It is preferable that the Ni content in the raw material forming the anode electrode be 0.65% by mass or less, especially 0.55% by mass or less. When the Ni content is such a Ni content, Ni is hardly incorporated into the Al electrodeposit of the cathode electrode and the purity of Al recovered can be improved. The smoothness of the Al electrodeposit can be improved and the recovery rate of Al can be improved. It is preferable that the Ni content in the raw material forming the anode electrode be 0.002 to 0.45% by mass, it is more preferable that the Ni content be 0.009 to 0.40% by mass, and it is further preferable that the Ni content be 0.02 to 0.30% by mass.

(h) Ti

In a casting material, Ti is added for micronizing crystal grains, preventing hot cracks, and improving creep characteristics. For example, when aluminum alloy scrap such as a casting material is used for the anode electrode, Ti is therefore contained in the raw material forming the anode electrode. It is preferable that the Ti content in the raw material forming the anode electrode be 0.4% by mass or less, especially 0.3% by mass or less. When the Ti content is such a Ti content, Ti is hardly incorporated into the Al electrodeposit of the cathode electrode and the purity of Al recovered can be improved. The smoothness of the Al electrodeposit can be improved and the recovery rate of Al can be improved. It is preferable that the Ti content in the raw material forming the anode electrode be 0.001 to 0.25% by mass, it is more preferable that the Ti content be 0.005 to 0.2% by mass, and it is further preferable that the Ti content be 0.010 to 0.18% by mass.

(i) Pb

In a casting material, Pb is added for improving cutting properties. For example, when aluminum alloy scrap such as a casting material is used for the anode electrode, Pb is therefore contained in the raw material forming the anode electrode. It is preferable that the Pb content in the raw material forming the anode electrode be 0.45% by mass or less, especially 0.35% by mass or less. When the Pb content is such a Pb content, Pb is hardly Incorporated into the Al electrodeposit of the cathode electrode and the purity of Al recovered can be improved. The smoothness of the Al electrodeposit can be improved and the recovery rate of Al can be improved. It is preferable that the Pb content in the raw material forming the anode electrode be 0.001 to 0.28% by mass, it is more preferable that the Pb content be 0.006 to 0.23% by mass, and it is further preferable that the Pb content be 0.01 to 0.21% by mass.

(j) Sn

In a casting material, Sn is added for improving cutting properties and imparting solid lubrication. For example, when aluminum alloy scrap such as a casting material is used for the anode electrode, Sn is therefore contained in the raw material forming the anode electrode. It is preferable that the Sn content in the raw material forming the anode electrode be 0.4% by mass or less, especially 0.3% by mass or less. When the Sn content is such a Sn content, Sn is hardly incorporated into the Al electrodeposit of the cathode electrode and the purity of Al recovered can be improved. The smoothness of the Al electrodeposit can be improved and the recovery rate of Al can be improved. It is preferable that the Sn content in the raw material forming the anode electrode be 0.001 to 0.25% by mass, it is more preferable that the Sn content be 0.005 to 0.20% by mass, and it is further preferable that the Sn content be 0.010 to 0.18% by mass.

(k) Cr

In a casting material, Cr is added for preventing stress corrosion cracking and improving heat resistance. For example, when aluminum alloy scrap such as a casting material is used for the anode electrode, Cr is therefore contained in the raw material forming the anode electrode. It is preferable that the Cr content in the raw material forming the anode electrode be 0.25% by mass or less, especially 0.15% by mass or less. When the Cr content is such a Cr content, Cr is hardly Incorporated into the Al electrodeposit of the cathode electrode and the purity of Al recovered can be improved. The smoothness of the Al electrodeposit can be improved and the recovery rate of Al can be improved. It is preferable that the Cr content in the raw material forming the anode electrode be 0.001 to 0.12% by mass, it is more preferable that the Cr content be 0.0025 to 0.10% by mass, and it is further preferable that the Cr content be 0.01 to 0.09% by mass.

As mentioned above, in the production method of one embodiment, an aluminum material with a high purity can be produced steadily, when the alloy components forming the anode electrode are in the above-mentioned ranges. In one embodiment, the anode electrode can include an aluminum alloy containing 0.01 to 30% by mass Si, 1.8% by mass or less Fe, 5.0% by mass or less Cu, 10.5% by mass or less Mg, and 1.5% by mass or less Mn, with the balance being Al and inevitable impurities. In another embodiment, the anode electrode can include an aluminum alloy containing 0.01 to 30% by mass Si, 1.8% by mass or less Fe, 5.0% by mass or less Cu, 10.5% by mass or less Mg, 1.5% by mass or less Mn, 3.0% by mass or less Zn, 0.55% by mass or less Ni, 0.3% by mass or less Ti, 0.35% by mass or less Pb, 0.3% by mass or less Sn, and 0.15% by mass or less Cr, with the balance being Al and inevitable impurities.

The shape of the anode electrode is not particularly limited as long as it is suitable for electrodeposition, and a platy anode electrode or anode electrode of an aggregate of particles can be used. Fragmentary particles, particulate particles, and powdery particles crushed and pulverized are included in the particles. When an anode electrode containing the aggregate of the particles is used, for example, a basket-like net made of SUS or the like is provided, and the anode electrode including the aggregate of particles can be obtained by filling the net with the particles. It is preferable that the average particle size of the respective particles forming the aggregate of the particles be 200 mm or less, especially 1 to 100 mm, and it is more preferable that the average particle size be 10 to 80 mm. When the particles forming the anode electrode are nonspherical, the average particle size of the particles is calculated by finding ((the major axis+the minor axis)/2) in the sections of particles. When the average particle size of the particles forming the anode electrode is in the above-mentioned ranges, the surface area of the whole anode electrode can be Increased and particles can be prevented from passing through the basket-like net to stop functioning as the anode electrode. Furthermore, when the average particle size is in the above-mentioned range of the average particle size, impurity elements other than Si dissolved and accumulated in the bath can be efficiently trapped by substitution reaction which occurs on the surface of the particles, and aluminum with a high purity can therefore be electrodeposited on the cathode electrode side. Since a basket-like net with a comparatively large mesh may be provided, an increase in cost is prevented, and aluminum can be efficiently electrodeposited. When a basket fabricated of a net made of aluminum is used, there is the effect of trapping of alloy additive elements and inevitable impurities contained in the Al alloy which is the raw material forming the anode electrode by substitution reaction. For this reason, it is preferable to use a basket-like net made of aluminum.

(Cathode Electrode)

The raw material forming the cathode electrode is not particularly limited as long as it enables electrodepositing Al. A metallic material such as platinum, gold, or copper; a metallic material such as titanium, nickel, or stainless steel having a passive film (oxide film); or the like can be used, however. When the metallic material having a passive film (oxide film) is used as the cathode electrode, the continuously electrodeposited aluminum material can be exfoliated from the surface of the cathode electrode by utilizing low adhesion to aluminum and recovered. The raw material forming the cathode electrode is not limited to the above-mentioned metallic material, and carbon, a plastic material to which conductivity is imparted, or the like can be used. Although the shape of the cathode electrode is not particularly limited, examples of the shape include shapes such as drums and plates. Since the aluminum material can be continuously electrodeposited on the cathode electrode, it is preferable to use a drum-like cathode electrode.

(Electrolytic Solution)

The standard electrode potential of aluminum is −1.662 V vs. SHE (standard hydrogen electrode). For this reason, aluminum cannot usually be electrodeposited from an aqueous solution. In the method for producing an aluminum material of one embodiment, it is preferable to use an electrolytic solution for electrodepositing aluminum having a specific composition. It is preferable to use a molten salt which is a mixture containing an aluminum salt or an organic solvent in which an aluminum salt is dissolved as this electrolytic solution. Molten salts are roughly classified into inorganic molten salts and organic room temperature type molten salts. In one embodiment, it is preferable to use a molten salt containing an alkylimidazolium halide and an aluminum halide as the organic room temperature type molten salt. The alkylimidazolium halide is, for example, an alkylimidazolium chloride. Specific examples of the alkylimidazolium halide include 1-ethyl-3-methylimidazolium chloride (hereinafter described as "EMIC"). Specific examples of the aluminum halide include aluminum chloride (hereinafter described as "$AlCl_3$"). The melting point of a mixture of EMIC and $AlCl_3$ decreases to around −50° C. depending on the composition. Therefore, aluminum can be electrodeposited under a lower temperature condition. Even though 1-butylpyridinium chloride (hereinafter described as "BPC") is used instead of EMIC, aluminum can be electrodeposited similarly to EMIC. Thus, the organic room temperature type molten salt including the alkylimidazolium chloride represented by EMIC or the alkylpyridinium chloride represented by BPC and the aluminum halide represented by aluminum chloride can be suitably used as the electrolytic solution for aluminum electrodeposition. The combination of EMIC and $AlCl_3$ is the most preferable from the viewpoints of the viscosity and the electric conductivity of the electrolytic solution. It is preferable that the molar ratio of EMIC to $AlCl_3$ (EMIC:$AlCl_3$) be 2:1 to 1:2, and it is more preferable that the ratio be 1:1 to 1:2.

(Additive)

In the production method of one embodiment, it is preferable to add 1,10-phenanthroline to the above-mentioned molten salt as an additive. It is preferable that the concentration of 1,10-phenanthroline in the electrolytic solution be 1 to 100 mM, and it is more preferable that the concentration be 5 to 50 mM. Crystal grains of aluminum in the aluminum material can be reduced, and the mechanical strength of the aluminum material can be increased by adding 1,10-phenanthroline to the electrolytic solution. The tear of the aluminum material and the falling of the aluminum material from the cathode electrode are prevented, and the recovery rate of the aluminum material can be improved thereby. When the concentration of 1,10-phenanthroline in the electrolytic solution is 1 mM or more, the effect of smoothing the surface of the aluminum material can be increased. When the concentration of 1,10-phenanthroline in the electrolytic solution is 100 mM or less, the aluminum film is not hard or fragile, and the falling of the aluminum material from the cathode electrode is prevented. Therefore, the recovery rate of the aluminum material can be improved. Other additives other than 1,10-phenanthroline can also be optionally added to the electrolytic solution. Examples of the other additives include benzene, toluene, and xylene.

(2) Depositing Aluminum on Cathode Electrode

In the production method of one embodiment, the anode electrode and the cathode electrode in an electrolytic solution are energized, and aluminum is deposited on the cathode electrode. In this step, aluminum is electrodeposited on the cathode electrode.

Hereinafter, conditions of this step will be described in detail.

(Area Ratio of Si to Surface of Anode Electrode)

It is preferable that the area ratio of Si to the surface of the anode electrode be 95% or less, especially 90% or less, it is more preferable that the area ratio be 80% or less, and it is further preferable that the area ratio be 70% or less. When the area ratio of Si to the surface of the anode electrode in the step (2) is in the above-mentioned range, the contamination of the electrolytic solution by the dissolution of Si in the electrolytic solution from the anode electrode can be effectively prevented. The area ratio of Si to the surface of the anode electrode is measured by the method described in the Examples mentioned below.

(Temperature of Electrolytic Solution)

It is preferable that the temperature of the electrolytic solution at the time of electrolysis be in the range of 25 to 200° C., and it is more preferable that the temperature be in the range of 50° C. to 150° C. When the temperature of the electrolytic solution is 25° C. or more, the viscosity and the resistance of the electrolytic solution are reduced and an aluminum material having a uniform film thickness can be obtained. For this reason, the deposition of aluminum proceeds especially at specific sites such as protruding parts on the surface of the cathode electrode to form dendrites, and the reduction of the recovery rate of aluminum caused by the falling of this can be prevented. When the temperature of the electrolytic solution is 200° C. or less, the composition of the electrolytic solution can be prevented from being unstable by the volatilization and the decomposition of compounds forming the electrolytic solution. Especially when the temperature of the electrolytic solution in the case of using a molten salt containing EMIC and $AlCl_3$ as an electrolytic solution is 200° C. or less, the volatilization of $AlCl_3$ and the decomposition of 1-ethyl-3-methylimidazolium cations can be inhibited and energy for maintaining the temperature of the electrolytic solution can also be reduced. Since the deterioration of the electrolytic cell can be inhibited, the production efficiency can be improved.

(Current Density)

The current density is preferably 1 to 400 mA/cm$^2$ and more preferably 10 to 200 mA/cm$^2$. Since the electrodeposition rate corresponds to the current density, the electrodeposition rate is increased and the production efficiency can be improved by adjusting the current density to 1 mA/cm$^2$ or more. The deterioration of the film formation efficiency (average film thickness/time) caused by the thickening of only specific sites of the electrodeposited aluminum or the thinning of the film thickness of the other most parts can be prevented. When the current density is adjusted to 400 mA/cm$^2$ or less, aluminum can be steadily electrodeposited, a moderate electrodeposition rate can be maintained, and the film thickness of the electrodeposited aluminum material can be unified.

(Stirring of Electrolytic Solution)

It is preferable to blow an inert gas at a flow velocity of 50 to 250 cm/min between the anode electrode and the cathode electrode and bubble the electrolytic solution with the inert gas at the time of electrolysis. As long as the inert gas is a gas which does not react with the electrolytic solution or does not Influence the effect of the present disclosure, the inert gas is not particularly limited. For example, argon, nitrogen, or the like can be used, however. Stirring the electrolytic solution at a predetermined flow velocity by bubbling enables accelerating substance transport essential for depositing aluminum on the cathode electrode. At this time, assuming that the inert gas passes in a space having the anode electrode and the cathode electrode as two planes, the flow velocity of inert gas can be calculated by dividing the flow rate (L/min) of the inert gas by the cross-sectional area of the space. When the anode electrode and the cathode electrode are platy, the flow velocity of the inert gas is calculated by dividing the flow rate of the inert gas by the cross-sectional area of a space having the surfaces of the anode electrode and the cathode electrode opposed to each other as two planes. When the cathode electrode is drum-like and the anode electrode is platy, the flow velocity of the inert gas Is calculated by dividing the flow rate of inert gas by the cross-sectional area of a space having the projected plane of the drum of the cathode electrode and the surface of the anode electrode opposed to the drum as two planes. When the areas of the surfaces of the anode electrode and the cathode electrode opposed to each other are different, the above-mentioned cross-sectional area is defined as the area of the section of the above-mentioned space at a middle point between the anode electrode and the cathode electrode. When the flow velocity of the inert gas is 50 cm/min or more, the deposition of aluminum proceeds at specific sites such as protruding parts on the surface of the cathode electrode to form dendrites and the reduction of the recovery rate of aluminum caused by the falling of this can be prevented. The stirring state of the electrolytic solution also influences crystal grains and the surface roughness. When the flow velocity of the inert gas is 50 cm/min or more, the uniformity of the shape of the aluminum crystal grains in the electrodeposited aluminum and the surface roughness of the aluminum can be improved. When the flow velocity of the inert gas is 250 cm/min or less, the exfoliation of aluminum from the cathode electrode can be prevented, normal film formation can be promoted, and also the uniformity of the shapes of aluminum crystal grains in the aluminum and the surface roughness of the aluminum can be improved. Consequently, the recovery rate of aluminum can be improved. The method for stirring the electrolytic solution is not limited to bubbling, and a jet stream or the like can be used.

(3) Recovering Aluminum Material

The production method of one embodiment may have a step of recovering an aluminum material after the above-mentioned step (2) as an additional step. In this step, the aluminum material can be continuously recovered by exfoliating the deposited aluminum material from the surface of the cathode electrode and winding the exfoliated aluminum material around a recovery drum. For example, after the aluminum material has a predetermined thickness, electrolysis is stopped temporarily, the aluminum material is exfoliated by rotating the cathode electrode, the exfoliated aluminum material may be wound while the exfoliated aluminum material is stuck on and laminated to the recovery drum. The aluminum material may be recovered as exfoliated pieces simultaneously with the exfoliation of the aluminum material.

(Aluminum Material)

Although the aluminum material obtained by electrodeposition is, for example, filmy and its thickness is usually 1 μm to 20 μm, its thickness may be suitably selected depending on use. For example, when the aluminum material is used as a positive electrode current collector of a lithium ion battery, it is preferable that the thickness be 10 μm or less.

2. Apparatus for Producing Aluminum Material

An apparatus for producing an aluminum material of one embodiment has an electrolytic cell storing an electrolytic solution, an anode electrode and a cathode electrode immersed in the electrolytic cell, and a voltage-applying unit configured to enable impressing voltage between the anode electrode and the cathode electrode. The anode electrode contains 0.01 to 30% by mass Si and Al.

FIG. 2 is a figure showing an apparatus 100 for producing an aluminum material of one embodiment. The apparatus 100 for producing an aluminum material of one embodiment has an electrolytic cell 6 storing an electrolytic solution 3, a drum-like cathode electrode 1 partially immersed in the electrolytic solution 3 and rotatably supported in the electrolytic cell 6, and a platy anode electrode 2 disposed so as to be opposed to the peripheral surface of the cathode electrode 1. In the production apparatus 100 of FIG. 2, a direct current power supply 8 is connected to the cathode electrode 1 and the anode electrode 2. This direct current power supply 8 constitutes a voltage-applying unit, and enables passing current between the cathode electrode 1 and the anode electrode 2.

A drum for recovery 9 is configured so that an aluminum material 5 electrodeposited on the cathode electrode 1 is exfoliated and wound around the drum for recovery 9 through an auxiliary roll 11. As shown in FIG. 2, the production apparatus 100 is provided with a thermocouple 12 for measuring the temperature of the electrolytic solution 3, a thermostat 13 for displaying the measured temperature, and a rubber heater 14 for warming the inside of a bath from outside the electrolytic cell 6, as a mechanism for adjusting the temperature in the electrolytic solution 3 of the electrolytic cell 6. The production apparatus 100 may be usually equipped with a glove box 15 so that operations are possible under the situation isolated from the open air. An aluminum material in which poor electrodeposition on the gas-liquid interface of the electrolytic solution 3 is inhibited can be produced with such a production apparatus.

Examples

Although, hereinafter, suitable embodiments of the present disclosure will be specifically described based on the Examples and the Comparative Examples, the present disclosure is not limited to these Examples.

Anode electrodes having component compositions described in the following Table 1, and electrolytic solutions having compositions described in Table 2 and the anode electrodes were provided. As shown in FIG. 2, the anode electrodes and a cathode electrode were immersed in the electrolytic solutions, respectively. At this time, each anode electrode and the cathode electrode were disposed so as to be separate from each other at an almost constant distance. An apparatus having a configuration shown in FIG. 2 was assembled, and an aluminum material having a thickness of around 10 μm was electrodeposited on the cathode electrode by energizing the anode electrode and the cathode electrode in the electrolytic solution at a current density of 40 mA/cm$^2$ and the temperature of the electrolytic solution shown in Table 2 for 12 minutes and passing direct current. More specifically, when an EMIC-$AlCl_3$, EMIC-$AlF_3$, EMIC-$AlBr_3$, or EMIC-$AlI_3$ electrolytic bath was used, an electrolytic bath in which the molar ratio was 1:2 and the bath temperature was 50° C. was used. When an $AlCl_3$—NaCl—KCl electrolytic bath was used, an electrolytic bath in which the molar ratio was 60:25:15 and the bath temperature was 150° C. was used. When a $DMSO_2$—$AlCl_3$ electrolytic bath was used, an electrolytic bath in which the molar ratio was 15:2 and the bath temperature was 110° C. was used. A cathode electrode made of titanium was used as the cathode electrode. In the present disclosure, the cathode electrode is not particularly limited, and can be suitably selected depending on the types of the anode electrode and the electrolytic bath, and, for example, a cathode electrode made of titanium, a cathode electrode made of SUS, a cathode electrode made of Cu, or the like can be used. As the anode electrode, an Al—Si alloy plate made of an Al alloy containing a Si content shown in the following Table 1 (20 mm in width and 50 mm in length) or particles with a predetermined average particle size filled in a basket-like net were used. The Si content in the anode electrode at the time of an electrodeposition start was analyzed with a quantometer (manufactured by SPECTRO: LAB). In Table 1, "-" means that the applicable element could not be detected in the measurement of the component composition of the anode electrode. In Table 2, a "plate" indicates a case where a plate of an Al—Si alloy made of an Al alloy was used as the anode electrode, and "particles" indicate a case where particles filled in a basket-like net were used as the anode electrode. In Table 2, "particle size" indicates the average particle size of particles filled in the basket-like net and forming the anode electrode.

TABLE 1

| Classification | | Component composition of anode electrode (% by mass) | | | | | | | | | | | | |
|---|---|---|---|---|---|---|---|---|---|---|---|---|---|---|
| | | Si | Fe | Cu | Mg | Mn | Zn | Ni | Ti | Pb | Sn | Cr | Al | Inevitable impurities |
| Example | 1 | 0.010 | — | — | — | — | — | — | — | — | — | — | 99.940 | Balance |
| | 2 | 0.100 | 0.006 | 0.017 | 0.035 | 0.005 | 0.010 | 0.002 | 0.001 | 0.001 | 0.001 | 0.001 | 99.622 | Balance |
| | 3 | 0.500 | 0.030 | 0.083 | 0.175 | 0.025 | 0.050 | 0.009 | 0.005 | 0.006 | 0.005 | 0.003 | 98.909 | Balance |
| | 4 | 10.000 | 0.600 | 1.667 | 3.500 | 0.500 | 1.000 | 0.183 | 0.100 | 0.117 | 0.100 | 0.050 | 81.983 | Balance |
| | 5 | 18.000 | 1.080 | 3.000 | 6.300 | 0.900 | 1.800 | 0.330 | 0.180 | 0.210 | 0.180 | 0.090 | 67.730 | Balance |
| | 6 | 20.000 | 1.200 | 3.333 | 7.000 | 1.000 | 2.000 | 0.367 | 0.200 | 0.233 | 0.200 | 0.100 | 64.167 | Balance |
| | 7 | 30.000 | 1.800 | 5.000 | 10.500 | 1.500 | 3.000 | 0.550 | 0.300 | 0.350 | 0.300 | 0.150 | 46.350 | Balance |
| | 8 | 9.600 | 0.576 | 1.600 | 3.360 | 0.480 | 0.960 | 0.176 | 0.096 | 0.112 | 0.096 | 0.048 | 82.696 | Balance |
| | 9 | 11.200 | 0.672 | 1.867 | 3.920 | 0.560 | 1.120 | 0.205 | 0.112 | 0.131 | 0.112 | 0.056 | 79.845 | Balance |
| | 10 | 10.800 | 0.648 | 1.800 | 3.780 | 0.540 | 1.080 | 0.198 | 0.108 | 0.126 | 0.108 | 0.054 | 80.558 | Balance |
| | 11 | 12.000 | 0.720 | 2.000 | 4.200 | 0.600 | 1.200 | 0.220 | 0.120 | 0.140 | 0.120 | 0.060 | 78.420 | Balance |
| | 12 | 0.500 | 0.030 | 0.083 | 0.175 | 0.025 | 0.050 | 0.009 | 0.005 | 0.006 | 0.005 | 0.003 | 98.909 | Balance |
| | 13 | 0.500 | 0.030 | 0.083 | 0.175 | 0.025 | 0.050 | 0.009 | 0.005 | 0.006 | 0.005 | 0.003 | 98.909 | Balance |
| | 14 | 0.500 | 0.030 | 0.083 | 0.175 | 0.025 | 0.050 | 0.009 | 0.005 | 0.006 | 0.005 | 0.003 | 98.909 | Balance |
| | 15 | 0.500 | 0.030 | 0.083 | 0.175 | 0.025 | 0.050 | 0.009 | 0.005 | 0.006 | 0.005 | 0.003 | 98.909 | Balance |
| | 16 | 0.500 | 0.030 | 0.083 | 0.175 | 0.025 | 0.050 | 0.009 | 0.005 | 0.006 | 0.005 | 0.003 | 98.909 | Balance |
| | 17 | 0.500 | 0.030 | 0.083 | 0.175 | 0.025 | 0.050 | 0.009 | 0.005 | 0.006 | 0.005 | 0.003 | 98.909 | Balance |
| | 18 | 0.500 | 0.030 | 0.083 | 0.175 | 0.025 | 0.050 | 0.009 | 0.005 | 0.006 | 0.005 | 0.003 | 98.909 | Balance |
| | 19 | 12.000 | 1.900 | 2.000 | 4.200 | 0.600 | 1.200 | 0.220 | 0.120 | 0.140 | 0.120 | 0.060 | 77.240 | Balance |
| | 20 | 12.000 | 0.720 | 5.100 | 4.200 | 0.600 | 1.200 | 0.220 | 0.120 | 0.140 | 0.120 | 0.060 | 75.320 | Balance |
| | 21 | 12.000 | 0.720 | 2.000 | 10.600 | 0.600 | 1.200 | 0.220 | 0.120 | 0.140 | 0.120 | 0.060 | 72.020 | Balance |
| | 22 | 12.000 | 0.720 | 2.000 | 4.200 | 1.600 | 1.200 | 0.220 | 0.120 | 0.140 | 0.120 | 0.060 | 77.420 | Balance |
| | 23 | 12.000 | 0.720 | 2.000 | 4.200 | 0.600 | 3.100 | 0.220 | 0.120 | 0.140 | 0.120 | 0.060 | 76.520 | Balance |
| | 24 | 12.000 | 0.720 | 2.000 | 4.200 | 0.600 | 1.200 | 0.650 | 0.120 | 0.140 | 0.120 | 0.060 | 77.990 | Balance |

TABLE 1-continued

| Classification | | Component composition of anode electrode (% by mass) | | | | | | | | | | | | |
|---|---|---|---|---|---|---|---|---|---|---|---|---|---|---|
| | | Si | Fe | Cu | Mg | Mn | Zn | Ni | Ti | Pb | Sn | Cr | Al | Inevitable impurities |
| | 25 | 12.000 | 0.720 | 2.000 | 4.200 | 0.600 | 1.200 | 0.220 | 0.400 | 0.140 | 0.120 | 0.060 | 78.140 | Balance |
| | 26 | 12.000 | 0.720 | 2.000 | 4.200 | 0.600 | 1.200 | 0.220 | 0.120 | 0.450 | 0.120 | 0.060 | 78.110 | Balance |
| | 27 | 12.000 | 0.720 | 2.000 | 4.200 | 0.600 | 1.200 | 0.220 | 0.120 | 0.140 | 0.400 | 0.060 | 78.140 | Balance |
| | 28 | 12.000 | 0.720 | 2.000 | 4.200 | 0.600 | 1.200 | 0.220 | 0.120 | 0.140 | 0.120 | 0.250 | 78.230 | Balance |
| | 29 | 11.500 | 0.690 | 1.917 | 4.025 | 0.575 | 1.150 | 0.211 | 0.115 | 0.134 | 0.115 | 0.058 | 79.311 | Balance |
| | 30 | 9.800 | 1.900 | 5.100 | 3.430 | 0.490 | 0.980 | 0.180 | 0.098 | 0.114 | 0.098 | 0.049 | 77.561 | Balance |
| | 31 | 11.100 | 0.666 | 5.100 | 10.600 | 0.555 | 1.110 | 0.204 | 0.111 | 0.130 | 0.111 | 0.056 | 70.059 | Balance |
| | 32 | 11.500 | 0.690 | 1.917 | 10.600 | 1.600 | 1.150 | 0.211 | 0.115 | 0.134 | 0.115 | 0.058 | 71.711 | Balance |
| | 33 | 10.000 | 1.900 | 1.667 | 3.500 | 1.600 | 1.000 | 0.183 | 0.100 | 0.117 | 0.100 | 0.050 | 79.583 | Balance |
| | 34 | 0.500 | 1.900 | 5.100 | 10.600 | 1.600 | 3.100 | 0.650 | 0.400 | 0.450 | 0.400 | 0.250 | 74.850 | Balance |
| Comparitive Example | 1 | — | 1.800 | 5.000 | 10.500 | 1.500 | 3.000 | 0.550 | 0.300 | 0.350 | 0.300 | 0.150 | 76.350 | Balance |
| Comparitive Example | 2 | 40.000 | 1.800 | 5.000 | 10.500 | 1.500 | 3.000 | 0.550 | 0.300 | 0.350 | 0.300 | 0.150 | 36.350 | Balance |

TABLE 2

| | Alloy component | Component of electrolytic solution | Temperature of electrolytic solution (° C.) | Shape of anode electrode | Particle size of constituent particles of anode electrode (mm) |
|---|---|---|---|---|---|
| Example | 1 | EMIC-$AlCl_3$ | 50 | Plate | — |
| | 2 | | | | |
| | 3 | | | | |
| | 4 | | | | |
| | 5 | | | | |
| | 6 | | | | |
| | 7 | | | | |
| | 8 | | | | |
| | 9 | | | | |
| | 10 | | | | |
| | 11 | | | | |
| | 12 | | | Particle | 0.1 |
| | 13 | | | | 1 |
| | 14 | | | | 10 |
| | 15 | | | | 50 |
| | 16 | | | | 80 |
| | 17 | | | | 100 |
| | 18 | | | | 200 |
| | 19 | | | Plate | — |
| | 20 | | | | |
| | 21 | | | | |
| | 22 | | | | |
| | 23 | | | | |
| | 24 | | | | |
| | 25 | | | | |
| | 26 | | | | |
| | 27 | | | | |
| | 28 | | | | |
| | 29 | EMIC-$AlF_3$ | | | |
| | 30 | EMIC-$AlBr_3$ | | | |
| | 31 | EMIC-$AlI_3$ | | | |
| | 32 | $AlCl_3$-NaCl-KCl | 150 | | |
| | 33 | $DMSO_2$-$AlCl_3$ | 110 | | |
| | 34 | $AlCl_3$-NaCl-KCl | 150 | | 200 |
| Comparative Example | 1 | EMIC-$AlCl_3$ | 50 | Plate | — |
| | 2 | | | | |

The above-mentioned Examples and Comparative Examples were evaluated in accordance with the following evaluation standard.

(Area Ratio of Si to Surface of Anode Electrode)

The surface of the anode electrode after electrolysis was analyzed with a SEM (manufactured by Hitachi High-Tech Corporation: SU8230) and an EDS (manufactured by Bruker Japan K.K.: FlatQuad). A region in the range in a visual field of 0.5×0.5 $mm^2$ on the surface of the anode electrode was more specifically photographed with the SEM. Si existing in this region was Identified with the EDS. Then, (the area of Si)/(0.5×0.5 $mm^2$)×100 was calculated as the area ratio of Si using image analysis software (produced by Mitani Corporation: WinRoof2015). An anode electrode in which the area ratio of Si was 70% or less was evaluated as "excellent". An anode electrode in which the area ratio of Si was more than 70% and 90% or less was evaluated as "good". An anode electrode in which the area ratio of Si was more than 90% was evaluated as "fair".

(Content of Si in Aluminum Material Electrodeposited on Cathode Electrode)

The content of Si in the aluminum material electrodeposited on the cathode electrode after the energization of the cathode electrode and the anode electrode was analyzed using an electron probe microanalyzer (EPMA) (manufactured by SHIMADZU CORPORATION: EPMA-1610). An aluminum material for which the measurement result of the content of Si in the aluminum material was 0% was evaluated as "excellent". An aluminum material for which the measurement result of the content of Si in the aluminum material was more than 0% and 5% or less was evaluated as "good". An aluminum material for which the measurement result of the content of Si in the aluminum material was more than 5% and 10% or less was evaluated as "fair". An aluminum material for which the measurement result of the content of Si in the aluminum material was more than 10% was evaluated as "poor". Since, in measurement with EPMA, the Si content which is 0.01% by mass or less could not be measured, as to aluminum materials having this Si content or less, all the Si contents were defined as 0.

Example in which all the evaluations were "excellent"; or two were "excellent", and one was "good" was evaluated as "superior", Example in which one was "excellent", and two were "good" was evaluated as "excellent", Example in which one was "fair", and the others were "excellent" or "good" was evaluated as "good", Example in which two were "fair", and the other was "excellent" or "good" was evaluated as "fair", and Example in which even one was "poor" was evaluated as "poor", The above-mentioned evaluation results are shown in the following Table 3.

TABLE 3

| | Alloy componen | Area ratio of Si to surface of anode electrode (%) | Determination | Amount of Si of cathode electrode | Determination | Cost | Overall determination |
|---|---|---|---|---|---|---|---|
| Example | 1 | 0.10 | Excellent | 0.0 | Excellent | Good | Superior |
| | 2 | 1.00 | Excellent | 0.0 | Excellent | Excellent | Superior |
| | 3 | 1.50 | Excellent | 0.0 | Excellent | Excellent | Superior |
| | 4 | 5.00 | Excellent | 0.0 | Excellent | Excellent | Superior |
| | 5 | 15.00 | Excellent | 0.0 | Excellent | Excellent | Superior |
| | 6 | 65.00 | Excellent | 0.0 | Excellent | Excellent | Superior |
| | 7 | 70.00 | Excellent | 1.0 | Good | Excellent | Superior |
| | 8 | 90.00 | Good | 4.9 | Good | Excellent | Excellent |
| | 9 | 30.00 | Excellent | 0.0 | Excellent | Excellent | Superior |
| | 10 | 30.00 | Excellent | 0.0 | Excellent | Excellent | Superior |
| | 11 | 30.00 | Excellent | 0.0 | Excellent | Excellent | Superior |
| | 12 | 89.00 | Good | 1.0 | Good | Excellent | Excellent |
| | 13 | 81.00 | Good | 0.0 | Excellent | Excellent | Superior |
| | 14 | 18.00 | Excellent | 0.0 | Excellent | Excellent | Superior |
| | 15 | 24.00 | Excellent | 0.0 | Excellent | Excellent | Superior |
| | 16 | 50.00 | Excellent | 0.0 | Excellent | Excellent | Superior |
| | 17 | 70.00 | Excellent | 0.0 | Excellent | Excellent | Superior |
| | 18 | 85.00 | Good | 5.0 | Good | Excellent | Excellent |
| | 19 | 89.00 | Good | 5.0 | Good | Excellent | Excellent |
| | 20 | 87.00 | Good | 5.0 | Good | Excellent | Excellent |
| | 21 | 80.00 | Good | 5.0 | Good | Excellent | Excellent |
| | 22 | 85.00 | Good | 5.0 | Good | Excellent | Excellent |
| | 23 | 83.00 | Good | 5.0 | Good | Excellent | Excellent |
| | 24 | 84.00 | Good | 5.0 | Good | Excellent | Excellent |
| | 25 | 82.00 | Good | 5.0 | Good | Excellent | Excellent |
| | 26 | 87.00 | Good | 5.0 | Good | Excellent | Excellent |
| | 27 | 88.00 | Good | 5.0 | Good | Excellent | Excellent |
| | 28 | 85.00 | Good | 5.0 | Good | Excellent | Excellent |
| | 29 | 81.00 | Good | 10.0 | Fair | Excellent | Good |
| | 30 | 85.00 | Good | 8.0 | Fair | Excellent | Good |
| | 31 | 84.00 | Good | 5.0 | Good | Excellent | Excellent |
| | 32 | 85.00 | Good | 9.0 | Fair | Excellent | Good |
| | 33 | 83.00 | Good | 5.0 | Good | Excellent | Excellent |
| | 34 | 95.00 | Fair | 10.0 | Fair | Excellent | Fair |
| Comparative Example | 1 | 0.05 | Excellent | 0.0 | Excellent | Poor | Poor |
| | 2 | 95.00 | Fair | 16.0 | Poor | Excellent | Poor |

(Cost)

In the measurement of the component composition of the anode electrode, the cost merit was evaluated according to the following standard. When the total of the concentrations of the detected elements was less than 99.95% by mass, it was determined that the cost merit obtained by recycling was the highest, and the cost merit was evaluated as "excellent". When the total of the concentrations of the detected elements was 99.95% by mass or more, and Si was detected, it was determined that there was the cost merit obtained by recycling, and the cost merit was evaluated as "good". When the total of the concentrations of the detected elements was 99.95% by mass or more, and Si was not detected, it was determined that the cost merit obtained by recycling was hardly obtained, and the cost merit was evaluated as "poor".

(Overall Evaluation)

The above-mentioned three items were evaluated as follows in order of excellence. That is, FIG. 1 is a scanning electron microscope (SEM) image obtained by photographing the surface of the anode electrode after electrolysis in Example 4. As shown in FIG. 1, the area ratio of Si existing on the surface of the anode electrode after electrolysis was low and 5% by mass, and the Si content in the electrodeposited aluminum material was 0% by mass. For this reason, it is found that Al was dissolved steadily in the electrolytic solution from the surface of the anode electrode, and the aluminum material with a high purity was obtained.

Since, in Examples 1 to 28, the Si content in the aluminum material was 0.01 to 30% by mass, the overall evaluations were "fair", "good", "excellent", and "superior". Meanwhile, since, in Comparative Example 1, Si in the aluminum material was not detected, the overall evaluation was "poor". Since Comparative Example 2 had a high content of Si in the anode electrode, Si could not be completely removed and the Si content in the electrodeposited aluminum material was high. The surface of the anode electrode after electrolysis was covered with Si, the area ratio of Si was 95%, and the content of Si in the electrodeposited aluminum material was also high. Consequently, the overall evaluation of Comparative Example 2 was "poor".

The present disclosure relates to a technique for obtaining an aluminum material with a high purity by reusing aluminum alloy scrap for castings, or the like heavily used for industrial products such as automobiles as an anode electrode.

What is claimed is:

1. A method for producing an aluminum material, comprising:

providing an electrolytic cell in which an anode electrode containing 1.0 to 30% by mass Si and Al and a cathode electrode are immersed in an electrolytic solution; and depositing aluminum on the cathode electrode by energizing the anode electrode and the cathode electrode in the electrolytic solution, wherein the anode electrode comprises an aluminum alloy containing said Si: 1.0 to 30% by mass, Fe: 1.8% by mass or less, Cu: 5.0% by mass or less, Mg: 10.5% by mass or less, Mn: 1.5% by mass or less, Zn: 3.0% by mass or less, Ni: 0.55% by mass or less, Ti: 0.3% by mass or less, Pb: 0.35% by mass or less, Sn: 0.3% by mass or less, and Cr: 0.15% by mass or less, with the balance being said Al and inevitable impurities, wherein an area ratio of Si to a surface of the anode electrode is 90% or less after depositing aluminum on the cathode electrode.

2. The method for producing an aluminum material according to claim 1, further comprising recovering the aluminum material by exfoliating the deposited aluminum from a surface of the cathode electrode and winding the exfoliated aluminum material around a recovery drum.

3. A method for producing an aluminum material, comprising:

providing an electrolytic cell in which an anode electrode containing 1.0 to 30% by mass Si and Al and a cathode electrode are immersed in an electrolytic solution; and depositing aluminum on the cathode electrode by energizing the anode electrode and the cathode electrode in the electrolytic solution, wherein the anode electrode comprises an aluminum alloy containing said Si: 1.0 to 30% by mass, Fe: 1.8% by mass or less, Cu: 5.0% by mass or less, Mg: 10.5% by mass or less, Mn: 1.5% by mass or less, Zn: 3.0% by mass or less, Ni: 0.55% by mass or less, Ti: 0.3% by mass or less, Pb: 0.35% by mass or less, Sn: 0.3% by mass or less, and Cr: 0.15% by mass or less, with the balance being said Al and inevitable impurities, wherein the electrolytic solution comprises a molten salt containing an alkylimidazolium halide and an aluminum halide.

4. A method for producing an aluminum material, comprising:

providing an electrolytic cell in which an anode electrode containing 1.0 to 30% by mass Si and Al and a cathode electrode are immersed in an electrolytic solution; and depositing aluminum on the cathode electrode by energizing the anode electrode and the cathode electrode in the electrolytic solution, wherein the anode electrode comprises an aluminum alloy containing said Si: 1.0 to 30% by mass, Fe: 1.8% by mass or less, Cu: 5.0% by mass or less, Mg: 10.5% by mass or less, Mn: 1.5% by mass or less, Zn: 3.0% by mass or less, Ni: 0.55% by mass or less, Ti: 0.3% by mass or less, Pb: 0.35% by mass or less, Sn: 0.3% by mass or less, and Cr: 0.15% by mass or less, with the balance being said Al and inevitable impurities, wherein the anode electrode is platy or an aggregate of particles having an average particle size of 1 to 100 mm.

5. A method for producing an aluminum material, comprising:

providing an electrolytic cell in which an anode electrode containing 1.0 to 30% by mass Si and Al and a cathode electrode are immersed in an electrolytic solution depositing aluminum on the cathode electrode by energizing the anode electrode and the cathode electrode in the electrolytic solution; and adding 1,10-phenanthroline to the electrolytic solution, wherein the anode electrode comprises an aluminum alloy containing said Si: 1.0 to 30% by mass, Fe: 1.8% by mass or less, Cu: 5.0% by mass or less, Mg: 10.5% by mass or less, Mn: 1.5% by mass or less, Zn: 3.0% by mass or less, Ni: 0.55% by mass or less, Ti: 0.3% by mass or less, Pb: 0.35% by mass or less, Sn: 0.3% by mass or less, and Cr: 0.15% by mass or less, with the balance being said Al and inevitable impurities.

6. A method for producing an aluminum material, comprising:

providing an electrolytic cell in which an anode electrode containing 0.5 to 30% by mass Si and Al and a cathode electrode are immersed in an electrolytic solution and depositing aluminum on the cathode electrode by energizing the anode electrode and the cathode electrode in the electrolytic solution, wherein the anode electrode comprises an aluminum alloy containing said Si: 0.5 to 30% by mass, Fe: 1.8% by mass or less, Cu: 5.0% by mass or less, Mg: 10.5% by mass or less, Mn: 1.5% by mass or less, Zn: 0.010 to 3.0% by mass, Ni: 0.55% by mass or less, Ti: 0.001 to 0.3% by mass, Pb: 0.001 to 0.35% by mass, Sn: 0.001 to 0.3% by mass or less, and Cr: 0.15% by mass or less, with the balance being said Al and inevitable impurities.

* * * * *